US009132895B2

(12) United States Patent
Heesterman

(10) Patent No.: US 9,132,895 B2
(45) Date of Patent: Sep. 15, 2015

(54) RESILIENT MOUNT FOR INTERCHANGEABLE FOIL

(71) Applicant: SFT Industrie Corp., San Clemente, CA (US)

(72) Inventor: Hugo Heesterman, San Clemente, CA (US)

( * ) Notice: Subject to any disclaimer, the term of this patent is extended or adjusted under 35 U.S.C. 154(b) by 267 days.

(21) Appl. No.: 13/889,447

(22) Filed: May 8, 2013

(65) Prior Publication Data

US 2014/0331909 A1 Nov. 13, 2014

(51) Int. Cl.
*B63B 1/28* (2006.01)
*B63B 35/79* (2006.01)

(52) U.S. Cl.
CPC ..... *B63B 35/793* (2013.01); *Y10T 29/49622* (2015.01)

(58) Field of Classification Search
CPC ..... B63B 35/7926; B63B 2035/009; B63B 2035/813; B63B 2039/063
See application file for complete search history.

(56) References Cited

U.S. PATENT DOCUMENTS 4,166,425 A 9/1979 Kummetz
4,498,410 A 2/1985 Budge
5,649,846 A 7/1997 Harper et al.
6,213,044 B1 4/2001 Rodgers et al.
6,821,173 B2 * 11/2004 McCausland et al. ..... 441/79
6,916,220 B2 7/2005 Davey et al.
7,001,236 B2 2/2006 Blake, Jr.
8,083,560 B2 12/2011 Foulke
2004/0248482 A1 12/2004 Larkin
2008/0268730 A1 10/2008 Heesterman
2010/0120305 A1 5/2010 Posner et al.

* cited by examiner

*Primary Examiner* — Edwin Swinehart
(74) *Attorney, Agent, or Firm* — Proxigee Legal Transactions; Elizabeth A. Nevis

(57) ABSTRACT

A mounting assembly for a removable foil improves acceleration, maneuverability, and control of craft such as boats or rideable boards (surfboards, sailboards, and the like) and also reduces repetitive stress exerted on the hull by foil bending and torsion. An off-center ball-and-cup joint in the mounting allows the foil to yaw and roll within a limited range in response to changes in lateral fluid pressure. A resilient pad in the mounting then exerts a restoring force to return the foil to a neutral orientation as the lateral pressure equilibrates. An elastically deformable cushion on the base of the foil may contribute to the resilient adaptation while excluding ambient water from the mounting. Optionally, the entire assembly may be mounted in a translation cage that allows adjustment of the foil's longitudinal position. Variations on removable foils, and cushions for the bases of foils, have thickened trailing ends to reduce turbulence.

26 Claims, 15 Drawing Sheets

RESILIENT MOUNT FOR INTERCHANGEABLE FOIL

RELATED APPLICATIONS

None

FEDERALLY SPONSORED RESEARCH AND DEVELOPMENT

None

APPENDICES

None

BACKGROUND

Related fields include foils that vary the inherent fluid-dynamic characteristics of attached vessel hulls or vehicle bodies by deriving lift, altering trim, reducing turbulence, or diminishing wave resistance; in particular, removable fins and foils for surfboards, sailboards, and pleasure or sport vessels.

Foils, fins, centerboards, skegs, and hydrodynamic keels can optimize lift, reduce drag, and stabilize a vessel hull or vehicle body (hereinafter generically referred to as "hulls") when mounted at a suitable angle of attack relative to the oncoming fluid. Foils also enhance drive and maneuverability in the fluid, acting in some ways like the friction of wheels on a solid surface. Here, a "fluid" may be either water or air.

Foil mountings can be permanent or removable. For example, a foil can be permanently attached with fasteners or adhesive to an inner layer partially constructed hull, then both foil and hull can be overcoated or overwrapped with outer layers such as fiberglass and resin. Removable foils can be inserted and withdrawn from sockets built into the hull, and fixed in place with fasteners or the like. Removable foils allow a user to change the number, type, or position of foils, adapting the hull to different fluid-dynamic performance demands imposed either by different surrounding conditions, different users, or different types of use. They also allow a user to quickly replace a damaged foil, or remove foils for easier storage or transport.

These removal and replacement operations can take place on beaches and shores, or sometimes even in the water. In these settings, mountings that require few or no tools to remove and replace a foil are convenient. Many users will sacrifice convenience if the foils are likely to wholly or partially self-detach in strong or turbulent currents. On the other hand, some foils are intentionally made frangible so that a substantial impact causes them to break away rather than damage the hull or injure the user or a nearby person or animal.

Rigid mountings and rigid foils can be simple and rugged, but they affect maneuverability when rapid turns are desirable or when the flow direction of the ambient fluid may change suddenly. The fluid-pressure drop causes bubble formation in the turbulent water on the leeward side of the foil, and the resulting cavitation or "crabbing" increases drag and can cause loss of control of the board or other craft; if the foil leaves the water completely, stall occurs, and there is a loss of control similar to a land vehicle's hydroplaning in a water puddle. Multiple foils mounted rigidly at different angles aid in turning, but can create drag that reduces the speed during carving into the face of the wave or straight-line travel. In a curve, a fin angled at a non-optimal orientation (not tangent to the curve) also increases drag. In addition, water leakage or shocks associated with repeated torsional stresses over time may cause strain damage to the foil mounting, or hull.

Self-aligning foils have a yielding component so that they tilt, pivot or flex temporarily when the angle of attack changes rapidly, then return to a default orientation and position as the surrounding forces stabilize. The angle of attack can be changed intentionally (as when turning) or a change can be imposed by external factors (as when an ambient current changes direction). A self-aligning foil can boost a vessel's or vehicle's acceleration through a curve and improve control in turbulent fluid environment. On many watercraft including surfboards and other aquatic-sports boards, most of the hydrodynamic force from the change of direction is concentrated on the leading edge of the foil. The pivoting range of the fin should not be too wide or too free, lest it delay the return to equilibrium after the turn or destabilize the board.

Therefore, vessels or vehicles with removable foils would benefit from a mounting system with an internal resilience property that would cause the foil to yaw or roll independent of the hull when the fluid-pressure difference between one side of the foil and the other exceeds a predetermined threshold, then return to a default orientation when the fluid-pressure difference falls below the threshold. Preferably, the yaw or roll angle would be limited to a useful range for the application. Preferably, some embodiments would allow the leading edge of the foil, where the pressure differences can be highest, to move. Preferably, the mounting would distribute torsional stresses and absorb shocks to lengthen component life. Preferably, the mounting and dismounting of foils would require no tools, but its configuration should reduce the probability of accidental detachment during use. Preferably, embodiments for sailboards or sailboats would include a compatible translation adjustment. Preferably, some embodiments of the mounting would be easy to install at non-perpendicular angles if desired. Preferably, embodiments of the mounting could be durably secured to foam layers of certain hulls.

SUMMARY

Embodiments of a resilient mounting assembly for a removable foil allow the foil to yaw and roll independently of the hull to which it is attached, whether or not the foil itself is made of a flexible or a rigid material.

In some embodiments, a socket mounted in the hull (either directly or in a larger box or cage) includes an interior cup. A sleeve inside the socket includes a convex spherical segment (hereinafter "ball") that seats in the cup and forms a joint allowing the sleeve to yaw and roll (or undergo a combined yaw and roll) relative to the socket. A convex barrel extending from the sleeve seats in a ramp extending from the cup in the socket. The ramp controls the amount of roll. Space around the perimeter of the sleeve partially defines the yaw and roll angle ranges.

In some embodiments, a resilient pad in the space between the sleeve and the socket is elastic in compression. The maximally-compressed thickness of the pad provides an additional limit on the yaw and roll angle ranges. The pad acts as a damping spring, resisting the sleeve more and more as it nears the limits of its allowed yaw and roll range. The pad also acts as a restoring spring, returning the sleeve to a default orientation in the absence of external bending force. Embodiments of the mounting pre-load the pad in compression so that lateral hydrodynamic force must exceed a threshold before the foil begins to yaw or roll. The pad also acts as a gasket to exclude ambient water from the socket.

In some embodiments, the sleeve and pad are held captive inside the socket by a slotted lid. The lid is configured to limit the sleeve's pitch range inside the socket while allowing the desired yaw and roll. In some embodiments, the pad has a tongue that acts as a gasket to exclude ambient water from the socket and slotted lid.

In some embodiments, a foil has a mounting tab protruding from it. To mount a "snap-in" or "push-in" embodiment of the foil, the tab is inserted through the slot in the lid and into a mating receptacle in the sleeve, where a retainer holds it by spring force, friction, or both. Some embodiments of the retainer include part of the pad that extends through a port in the sleeve into the sleeve receptacle. Detaching the foil involves pulling it straight out from the sleeve strongly enough to overcome the force of the retainer. As it is very rare for a surrounding fluid medium to exert a significant force in that direction, the foils are unlikely to be accidentally detached during use.

Some embodiments of the mounting tab and its mating receptacle in the sleeve have a shape synthesized from the combination of two posts and a connecting web. The end lobes guide the tab into the sleeve in alignment with the sleeve's axes of rotation. The connecting web absorbs the torsion imposed by the various fluid-dynamic forces. Some embodiments of the tab include features for secure integration with the foil.

Some embodiments of the foil include a cushioning material between the foil base and the hull. When the foil rolls, the cushion protects the hull from the edge of the foil base that tilts toward it, and prevents water from entering the gap between the hull and the edge of the foil base that tilts away from it.

Some embodiments of the cushion modify the root profile of the foil. The cushion may provide a thickened, squared-off trailing end for the foil base. This end may be as thick as the thickest part of the foil base, or only slightly (e.g., between about 10% and about 30% thinner This "spoiler-like" base profile, along with the elastic deformability of the cushion, optimizes the flow at the foil/hull interface to remain laminar over the full length of the foil and reduce the formation of swirls abaft the trailing edge of the foil. Some embodiments include a thickened trailing end on the foil as well as the cushion. Some embodiments of the foil also include a sharp cut at its end tip to optimize laminar flow around the tip of the foil and reduce the size of turbulent rake zone.

Embodiments of the resilient mounting for applications such as sailboarding, where performance can benefit from fine-adjusting the position of a foil, include an external cage that allow a user to loosen, translate, and re-anchor the lidded socket in a new position within the cage without disturbing the sleeve, pad, or retainer.

Some embodiments of the socket and cage include frangible pegs for adjusting the default orientation when installing the socket or cage in a hull. Embodiments of a manufacturing method include resting the socket or cage against the hull on the unbroken frangible pegs and attaching the socket or cage to the hull at the angle resulting from the contact of the hull with the pegs.

Embodiments of a manufacturing method for installing a socket or cage include cutting one or more thin, transverse peripheral channels extending into the hull material from the cavity in which the socket or cage is inserted, inserting the socket or cage into the cavity, and potting with adhesive so that the adhesive wicks into the peripheral channel(s). When the adhesive hardens, it forms a reinforcing vane with an enlarged surface area, making the socket or cage more difficult to dislodge from the hull. Where the hull material is compressible (for example, a foam), pressure on the larger-area vanes is less able to tear the material than pressure concentrated in a smaller area.

DETAILED DESCRIPTION

This Description will provide an overview of the functions of the resilient foil mounting, describe an example assembly, discuss variations on the parts of the assembly, and explore some installation techniques.

Figure 1A:
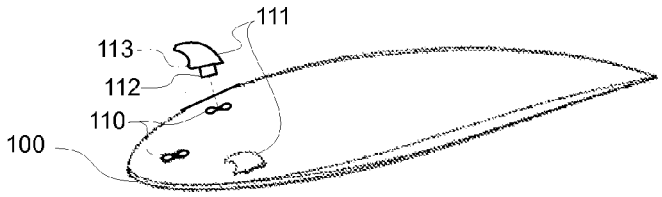
FIGS. 1A-1C are illustrations of removable foils and their mountings, and "yawing" and "rolling" motions as discussed herein.
Figure 1B:
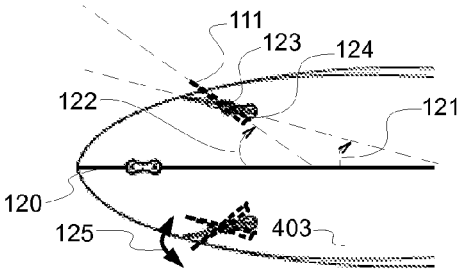
Figure 1C:
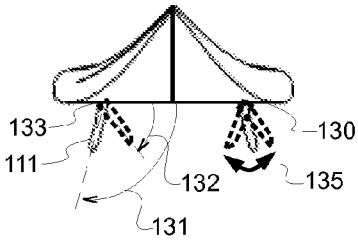

FIGS. 1A-1C are illustrations of removable foils and their mountings, and "yawing" and "rolling" motions as discussed herein. FIG. 1A shows the bottom hull surface of a surfboard. Removable foils, fins, or skegs 111 can be mounted in, or detached from, foil mountings 110. On surfboards, foil mountings like those illustrated here are also known as "fin boxes." In the illustrated embodiment, foil 111 has a tab 112 anchored to its base 113. When tab 112 is inserted into a mating sleeve in mounting 110, the mating parts secure foil 111 to hull 100. Here, mountings 110 and foils 111 are near the stern 100 of the hull.

FIG. 1B illustrates "yaw" as used herein. Foil 111 changes its angle relative to, roughly, longitudinal centerline 120 of the hull; for example, from angle 121 to angle 122. In the illustrated embodiment, pivot point 123 happens to be aft of the forward edge 124 of foil 111, so that forward edge 124 is free to move when foil 111 yaws. When a rider steers this type of board into a turn, the lateral hydrodynamic force is concentrated near the forward edge of the foil. Allowing that edge to align with respect to the fluid flow and speed vector produces a better combination of acceleration with stability in the turn than a foil that only bends about a stationary forward edge and base. As indicated by double directional arrow 125, embodiments of the mounting can allow the foil to yaw in either of two directions from its default orientation.

FIG. 1C illustrates "roll" as used herein. Foil 111 changes its angle relative to, roughly, the bottom surface (careen) 130 of the hull; for example, from angle 131 to angle 132. In the illustrated embodiment, pivot point 133 is near or slightly inside the outer surface of the hull. As indicated by double directional arrow 135, embodiments of the mounting can allow the foil to roll in either of two directions from its default orientation.

Figure 2A:
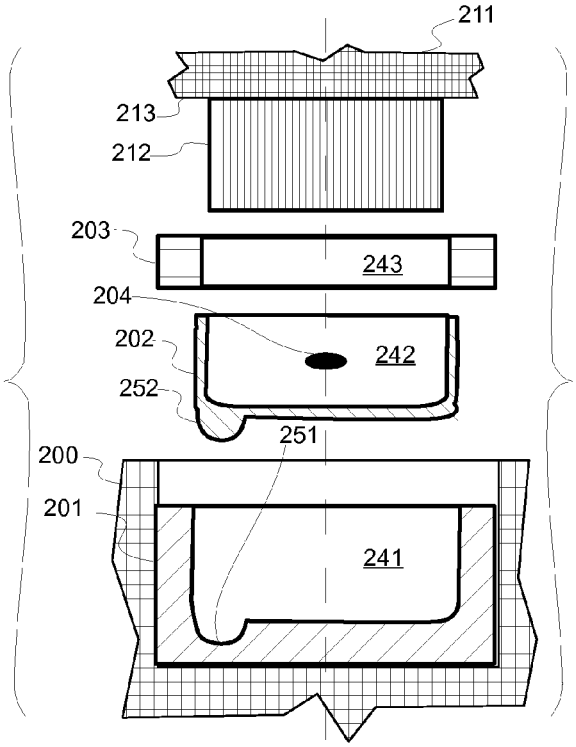
FIGS. 2A and 2B are schematics of some parts of the foil and mounting.
Figure 2B:
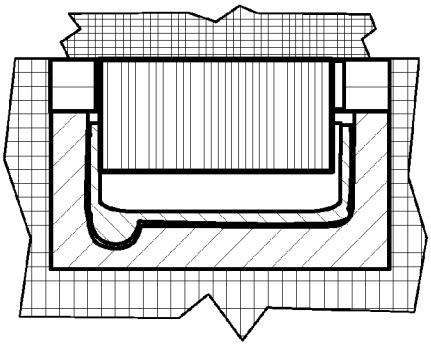

FIGS. 2A and 2B are schematics of some parts of the foil and mounting, presented as simplified cutaway views. In exploded cutaway schematic FIG. 2A, a foil 211 has a tab 212 protruding from its base 213. To engage the mounting, tab 212 passes through slot 243 in lid 203 to seat in receptacle 242 in sleeve 202, where it is retained by retainer 204.

Embedded in hull 200 is a socket 201. A chamber 241 in socket 201 is open at the side facing away from hull 200 (in the illustrated view, the top side), and has a cup 251 hollowed out of the side facing into the hull (in the illustrated view, the bottom side). Sleeve 202 has a ball 252 on its hullward (here, bottom) surface. Ball 252 is configured to rotatably seat in cup 251.

In FIG. 2B, the parts shown in FIG. 2A have been assembled. Sleeve 202 is inserted into chamber 241, with ball 252 rotatably seated in cup 251. Lid 203 is attached to socket 201, making sleeve 202 captive within chamber 241. In the illustrated embodiment, socket 201 is recessed inside hull 200 such that, when the mounting is assembled, the outer face (here, top) of lid 203 is made substantially flush with the surrounding surface of hull 200, but other embodiments may have the top of the lid protruding or recessed from the hull surface.

Suitable materials for sockets, sleeves, tabs and lids include resin or hard plastics with or without carbon fiber or other reinforcing fiber, metals such as stainless steel or aluminum (which may be anodized or otherwise coated), biologically-based polymers, and ceramics.

FIGS. 3A-3D schematically illustrate the pitch and yaw of a sleeve in the chamber of a socket, and the restoring forces that provide resilience. For simplicity in illustrating the restoring forces, the foil and its tab, as well as the mounting's lid and retainer, are not shown in these particular figures. However, note that because the foil's tab is retained in the sleeve as described above, the sleeve's angular orientation determines that of the inserted foil.

Figure 3A:
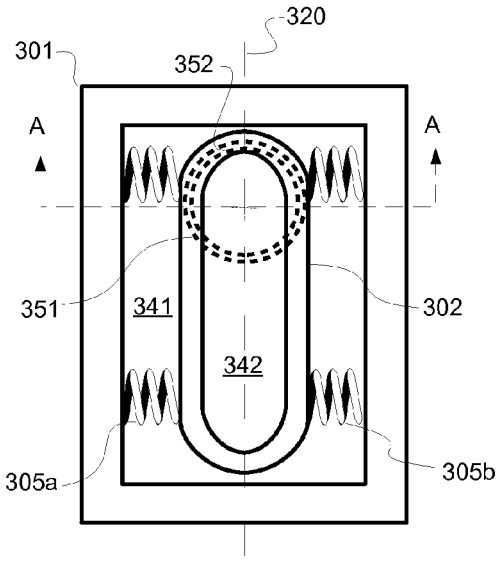
FIGS. 3A-3D schematically illustrate the pitch and yaw of a captive sleeve in the chamber of a socket, and the restoring forces that make the angular motions resilient.

FIG. 3A is a schematic plan view of the mounting without the lid in a yaw-neutral orientation. Sleeve 302 sits in chamber 341 of socket 301. The receptacle 342 of sleeve 302 is shown with its open side facing out of the page. The ball 352 of sleeve 302 and the cup 351 of socket 301 are shown as hidden lines because they are under the bottom of receptacle 342 in this view; ball 352 is seated in cup 351. The yaw restoring forces schematically illustrated as springs 305*a* and 305*b* are in balanced opposition; the springs are either unloaded or equally preloaded. In the illustration, restoring springs 305*a* and 305*b* are substantially symmetric so that the default orientation of sleeve 302 is substantially parallel to a longitudinal axis 320 of chamber 341. However, some designs intended for mounting off the axis of a hull may have asymmetric restoring springs so that the default orientation is not parallel to the longitudinal axis. Such designs may also incorporate a stronger preload on one side of the sleeve than the other, so that the foil is less resistant to yaw in one direction than the other.

Figure 3B:
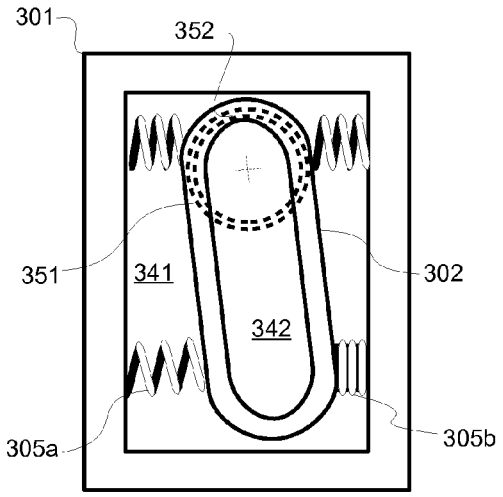

FIG. 3B is a plan view similar to FIG. 3A, except that the sleeve is yawed away from its default orientation within the chamber. Ball 352 is still seated in cup 351, but has rotated within its seating to respond to a lateral fluid-dynamic yawing force that changed the yaw angle of the foil (not shown), which in turn changed the yaw angle of its attached tab (not shown), and because the tab is retained in receptacle 342, this changed the yaw angle of sleeve 302. The orientation of socket 301 is not affected because of the freedom of ball 352 to rotate within cup 351. Therefore, the foil can change its orientation without putting strain on socket 301, which is permanently fixed into the hull.

To cause the sleeve to yaw out of its default orientation, the lateral fluid-dynamic force on the foil had to exceed the preload of spring 305*a* (if the springs are tension springs) or spring 305*b* (if the springs are compression springs). As the yaw angle increases, the restoring spring force increasingly opposes the yaw. The yaw stops increasing when the restoring force exceeds the fluid-dynamic force, or when the yaw angle reaches a limit of its range imposed by the mechanics of the foil, hull, or mounted parts. Then, when the lateral fluid-dynamic yawing force on the foil decreases (for example, when the hull re-orients itself parallel to the flow direction of the surrounding fluid), restoring forces 305*a*, 305*b*, or both will begin to overcome the fluid-dynamic force on the foil and push or pull the sleeve back to its yaw-neutral orientation. As the sleeve realigns itself, so too will the attached foil.

Figure 3C:
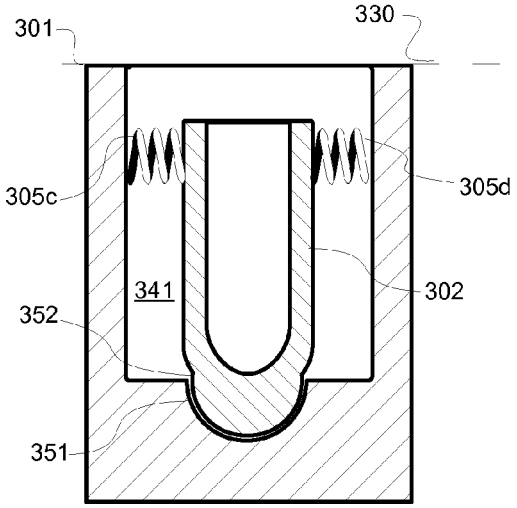

FIG. 3C is a schematic section through line A-A of FIG. 3A, showing the mounting without a lid in a roll-neutral orientation. Section A-A cuts through ball 352 and cup 351, so their seating is visible in this view. The roll restoring forces schematically illustrated as springs 305*c* and 305*d* are in balanced opposition; the springs are either unloaded or equally preloaded. In the illustration, restoring springs 305*c* and 305*d* are substantially symmetric so that the default orientation of sleeve 302 is substantially parallel to a transverse hull tangent 330. This default orientation is suitable for a central fin; some side-fin embodiments will have a different default orientation. However, some designs intended for mounting off the axis of a hull may have asymmetric restoring springs so that the default orientation is not parallel to the transverse hull tangent. Such designs may also incorporate a stronger preload on one side of the sleeve than the other, so that the foil is less resistant to roll in one direction than the other.

Figure 3D:
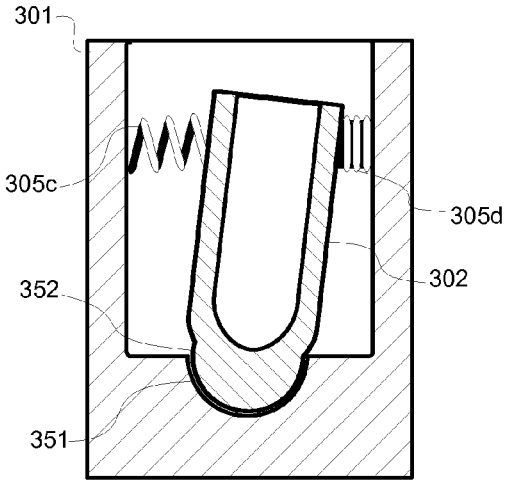

FIG. 3D is a schematic section view similar to FIG. 3C, except that the sleeve is rolled away from its default orientation within the chamber. Ball 352 is still seated in cup 351, but has rotated within its seating to respond to a lateral fluid-dynamic rolling force that changed the roll angle of the foil (not shown), which in turn changed the roll angle of its attached tab (not shown), and because the tab was retained in receptacle 342, this changed the roll angle of sleeve 302. The orientation of socket 301 is not affected because of the freedom of ball 352 to rotate within cup 351.

To cause the sleeve to roll out of its default orientation, the lateral fluid-dynamic force on the foil had to exceed the preload of spring 305*c* (if the springs are tension springs) or spring 305*d* (if the springs are compression springs). Some embodiments of springs may function as either tension or compression springs depending on the direction of the external force. The roll stops increasing when the restoring force exceeds the fluid-dynamic force, or when the roll angle reaches a limit of its range imposed by the mechanics of the foil, hull, or mounted parts. Then, when the lateral fluid-dynamic rolling force on the foil decreases (for example, when the hull re-orients itself parallel to the flow direction of the surrounding fluid), the lateral fluid-dynamic rolling force on the foil will decrease, and restoring spring force 305*c*, 305*d*, or both will begin to overcome the fluid-dynamic force on the foil and push or pull the sleeve back to its roll-neutral orientation. As the sleeve realigns itself, so too will the attached foil.

Some embodiments benefit from limiting the yaw and roll angle of the foil to a useful or safe range determined by its manner of use. For example, wind-tunnel tests on surfboard fins showed that lift exceeded drag only where the angle of attack was approximately 25 degrees or less, depending on the profile of the foil. In some embodiments, the limits of the yaw and roll angle ranges are determined by the lateral clearance between the outer surface of the sleeve and the inner wall of the socket chamber, or by the lateral clearance between the foil tab seated in the sleeve and the slot in the lid of the mounting, or by properties of the foil base such as its compressibility, width, and the space between the foil base and the hull. In some applications, however, an abrupt hard stop to the angle range is undesirable; for example, where impacts by the edge of the foil base could damage the hull, or where a sudden change of reaction to fluid-dynamic force could destabilize a balance-critical craft. Embodiments for those applications limit the angle ranges via the elastic limits of the restoring springs or cushioning on the foil tab or the foil base.

These illustrations show the effects of pure yaw and pure roll for simplicity. However, because of the rotational symmetry inherent in a ball-and-cup joint, the mounting will similarly yield and realign itself when acted upon by mixed yawing and rolling forces.

Figure 4A:
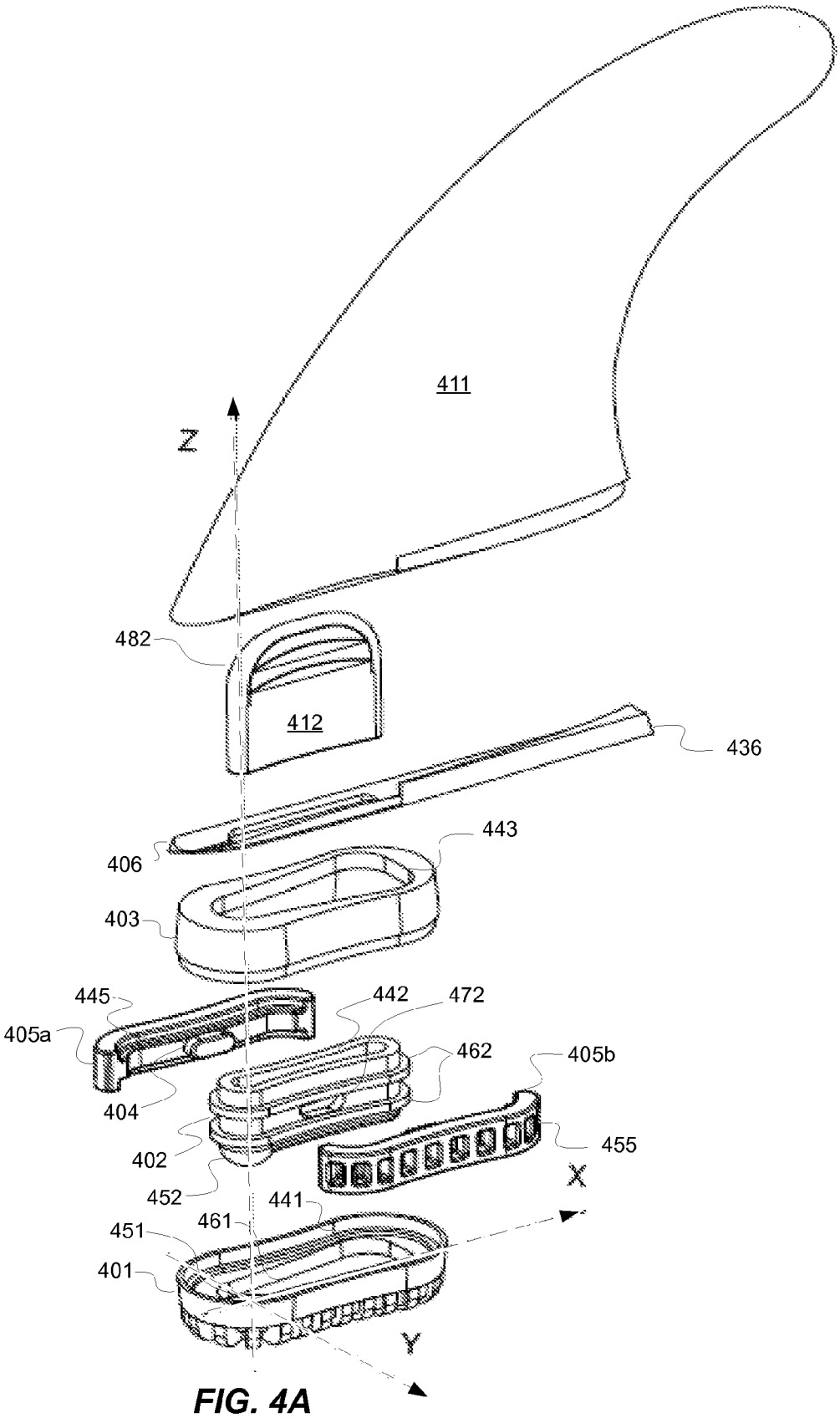
FIG. 4A is an exploded view of an embodiment of a mounting assembly, foil tab, and foil base.

FIG. 4A is an exploded view of an embodiment of a mounting assembly, foil cushion, foil tab, and foil. Foil tab 412 is secured in the base of foil 411. In the illustrated embodiment, rim 482 acts as a gripping feature to maintain the attachment of tab 412 to foil 411. In some embodiments, tab 412 extends through a cushion 406 on the base of foil 411. Cushion 406 may be filleted or chamfered, elastically deformable, or both. Some embodiments of the cushion conform to the foil base shape; for example, the cushion follows fillets or chamfers on the fin base. The elastic deformability may also adapt the shape of some cushion embodiments to changing flow speed and fluid pressure.

Its functions include allowing foil 411 to roll without pressing a sharp edge against the mounting lid or hull; such pressures might otherwise tend to lever the tab out of its intended position.

Some embodiments of cushion 406 include a thickened trailing end 436. The thickened trailing end has a substantially squared-off shape. Instead of the trailing taper often seen on foils, this profile thins only very slightly (e.g., less than about 30%) or does not thin at all aft of the thickest profile cross section. Each corner of the square end forms a sharp edge that creates a low pressure zone behind it, somewhat like the action of a spoiler, helping to prevent fluid unhooking from the foil surface in the trailing zone and reduce perturbation or vortex creation at the foil/hull interface.

Lid 403 has a slot 443, through which tab 412 passes to seat in receptacle 442 of sleeve 402. The illustrated embodiment of slot 443 is narrow at the end above the ball-and-cup joint formed by ball 452 on sleeve 402 and cup 451 on socket 401. The opposite end of slot 443 is flared to a greater width. This flared shape accommodates the yawing motion of tab 412 when sleeve 402 pivots around the ball-and-cup joint.

Surrounding sleeve 402 in the illustrated embodiment are resilient pad sections 405*a* and 405*b*, made of elastomer or another suitable elastically deformable material. Each pad has a raised inner strip 445, which fits between flanges 462 on sleeve 402. Flanges 462 stiffen and reinforce sleeve 402. This stiffening reinforcement preserves the shape and size of receptacle 442 through repeated torsional stresses transferred from foil 411 through tab 412 to sleeve 402 in a dynamic fluid environment. The stiffening reinforcement also prevents expansion or deformation of receptacle 442 through multiple insertions and removals of tab 412. A nub 404 extends further inward from each inner strip 445. When assembled, each nub 404 extends through a port 472 in sleeve 402 and into receptacle 442 to reduce locally the space available for tab 412 when inserted. Here, nub 404 and port 472 are illustrated as oval-shaped; however, ovoid, circular, rectangular, rounded-rectangular, polygonal, or any suitable shape can be used.

The pad embodiment shown here performs multiple functions. First, it provides the restoring forces against sleeve 402 for both rolling and yawing motion. The restoring spring constant can be controlled by changing the dimensions and spacing of openings 455 in the embodiment illustrated here. Alternatively, the restoring spring constant may be controlled by making the pad section from different materials or additives, or injecting different sizes or densities of bubbles in neoprene-like materials. Second, the inwardly-extending nubs 404 operate as a retainer, holding tab 412 in receptacle 442 by compression and friction. Third, it absorbs shocks, turbulent disruption that can be caused from air bubbles in the white water or "gust-like" effects caused by abrupt changes in flow direction and speed. Fourth, by wrapping completely around sleeve 402 when fully assembled, pads 405*a* and 405*b* fill the space between lid 403, socket 401, and the outside of sleeve 402 to exclude ambient fluid from chamber 441 in the interior of socket 401. If allowed into the chamber, ambient fluid could form a dead zone creating more drag on the foil and hull.

The X-Y-Z pivot point for roll and yaw is in chamber 441 of socket 401, in or above cup 451. At the bottom of chamber 441, adjacent to cup 451, a trench 461 has an outwardly flaring shape analogous to the flare in slot 443 to accommodate the yawing motion of sleeve 402.

Figure 4B:
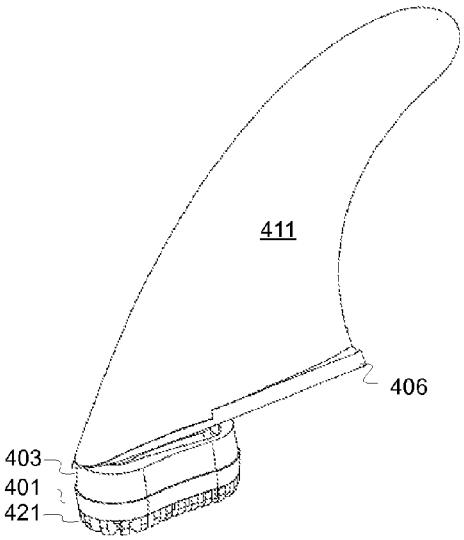
FIG. 4B is an assembled view of the exploded embodiment of FIG. 4A.

FIG. 4B is an assembled view of the assembled embodiment of FIG. 4A. When the mounting is assembled, pad sections 405*a* and 405*b* may be partially compressed between sleeve 402 and socket 401, and in some embodiments compressed in the orthogonal direction between socket 401 and lid 403. The partial compression pre-loads sleeve 402 in a yaw-neutral and roll-neutral orientation, and increases the threshold fluid-dynamic force required to yaw or roll a mounted foil out of the neutral position (compared to an embodiment with an uncompressed pad of the same material and design). Treads 421 are holding features for mounting socket 401 in a hull.

Figure 4C:
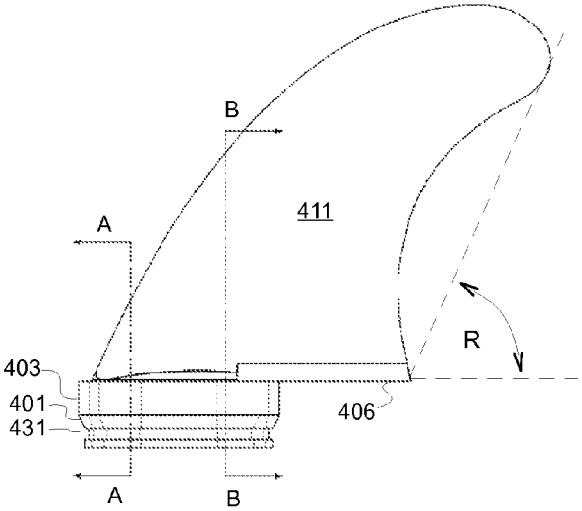
FIG. 4C is a side view of an assembled embodiment with a different version of socket 401.

FIG. 4C is a side view of an assembled embodiment with a different version of socket 401. Instead of treads 421 seen in FIG. 4C, this socket 401 has a perimeter groove 431. A wide variety of feature types known in the art for mounting foils in hulls of various compositions can also be used. FIG. 4C also shows the rake angle R of foil 411, which is one of the actor determining a torsion load imposed on tab 412 and sleeve 402; smaller rake angles R impose a larger torsion load when all other factors (in both the design and the environment) are equal. In embodiments where the pivot point is forward of the centerline of the foil, rake angle R is also a factor in yaw range.

Figure 4D:
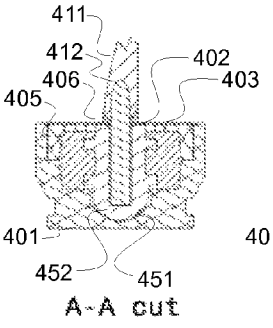
FIGS. 4D, 4E, 4F, ad 4G are sectional views through sections A-A and B-B of FIG. 4C.
Figure 4E:
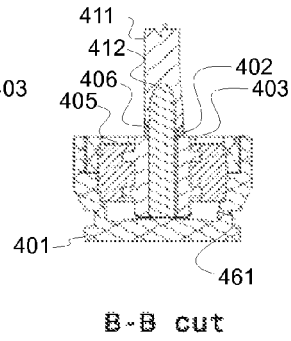
Figure 4F:
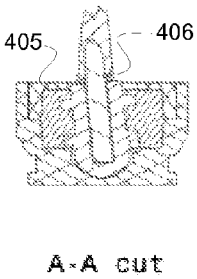

FIGS. 4D, 4E, 4F, ad 4G are sectional views through sections A-A and B-B of FIG. 4C. These figures illustrate the effect of yaw and roll of foil 411 on the interior of the assembly. FIG. 4D is a section through A-A with the foil in its neutral orientation (neither yawed nor rolled) and FIG. 4E is the corresponding B-B section. Section A-A goes through ball 452 seated in cup 451, near the X-Y-Z pivot point of the foil mounting, as well as foil 411, cushion 406, tab 412, lid 403, sleeve 402, and socket 401. Section B-B is positioned away from the X-Y-Z pivot point, where an outer bottom surface of sleeve 402 rests in trench 461 which include a ramp 407 to guide the barrel in its yaw and roll displacement. In this neutral position, all the Z (illustrated as vertical) axes of the components are substantially parallel (e.g., within less than 0.2 degrees) and the sections of pad 405 and cushion 406 are mirror images of each other.

Figure 4G:
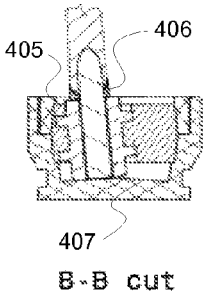

FIG. 4F is the A-A section, and FIG. 4G the B-B section, when foil 411 is both yawed and rolled to the right. The roll is evident in the tilt of foil 411, tab 412, and sleeve 402 away from the Z-axis angle of socket 401 and lid 403 in both the A-A and B-B sections. The yaw is evident in the off-center position of foil 411, tab 412, and sleeve 402 in the B-B section (away from the X-Y-Z pivot point) compared to their maintained centration in the A-A section (near the X-Y-Z pivot point). Both pad 405 and cushion 406 elastically compress on one side (here, the left side) and expand on the other side to accommodate the yaw and roll. As the fluid-dynamic force subsides, the restoring force in pad 405 will push sleeve 402 back to its neutral orientation, where cushion 406 and pad 405 will regain their former shapes.

Figure 5A:
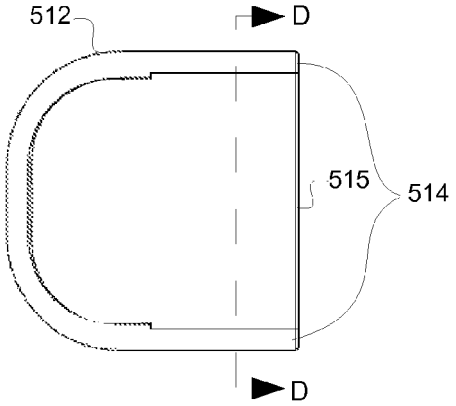
FIGS. 5A-5C illustrate the double-post with torsion-web shape of an embodiment of the tab and sleeve.
Figure 5B:
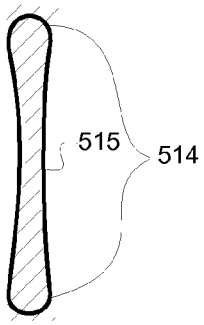
Figure 5C:
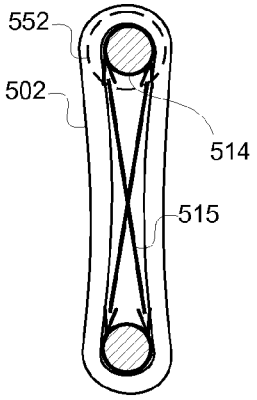
Figure 5D:
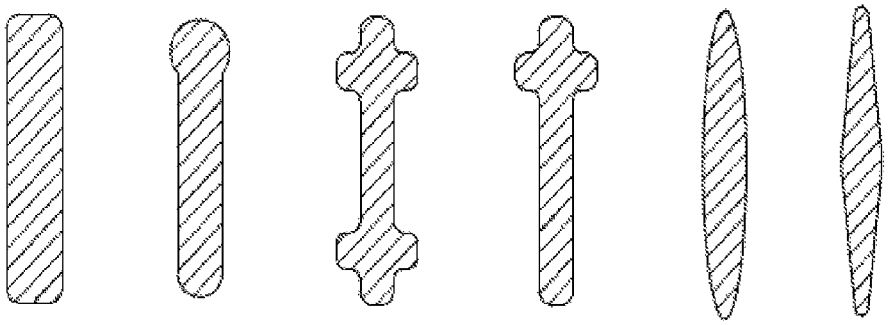
FIG. 5D illustrates variations in tab design.

FIGS. 5A-5D illustrate the double-post with torsion-web shape of an embodiment of the tab and sleeve. Tab 512 is shown as a side view in FIG. 5A, as a section through D-D of FIG. 5A in FIG. 5B, and as a schematic in FIG. 5C. Its shape combines two end posts 514 with a connecting web 515. Some embodiments of sleeve 502 have receptacle shapes that are close-fitting (running-and-sliding or push-fit) negative versions of the same form. End posts 514 guide tab 512 into the receptacle of sleeve 502. In the illustrated embodiment, one of the end posts 514 in the illustrated embodiment is coaxial with ball 552, which defines the yaw and roll pivot axes of sleeve 502; thus, posts 514 position tab 512 (and thereby the foil attached to tab 512) relative to the roll and yaw axes of the mounting. Connecting web 515 absorbs and distributes the torsion imposed when a nonuniform lateral fluid-dynamic force on the foil opposes the preload or restoring force of the pad or other spring on sleeve 502 in the mounting. FIG. 5D illustrates a cross-section analogous to 5B for some other embodiments. Many different cross-sections can work, and they need not be symmetrical or thinner toward the center. The tab can have a laminate construction, optionally including layers wrapped around two rods similar to the schematic of FIG. 5C.

Figure 6A:
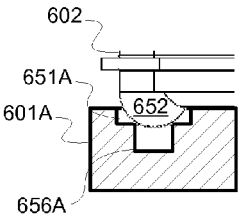
FIGS. 6A-6H illustrate some variations in socket design.
Figure 6B:
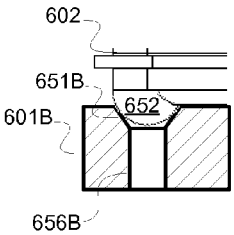

FIGS. 6A-6G illustrate some variations in socket design. In FIG. 6A, cup 651A in socket 601A is a counterbore, with ball 652 of sleeve 602 seated in the ring where counterbore 651A meets hole 656A. In FIG. 6B, cup 651B in socket 601B is a countersink, with ball 652 of sleeve 602 seated in the cone of countersink 651B. In the figures, hole 656A is illustrated as a blind hole and hole 656B is illustrated as a through-hole (which can also be used to inject cement or potting to seal socket 651B into the hull). However, either the blind hole or the through-hole can be used with either cup type, and if countersink 651B is sufficiently deep no hole 656B may be needed at all.

Figure 6C:
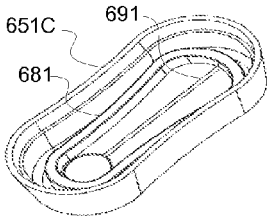
Figure 6D:
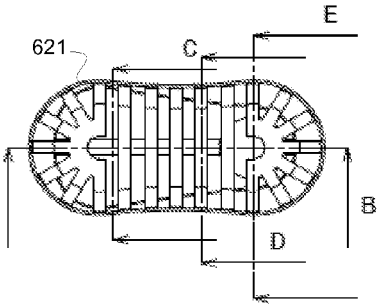
Figure 6E:
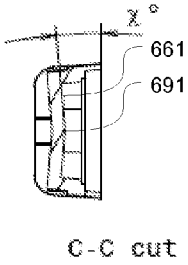
Figure 6F:
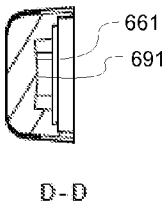
Figure 6G:
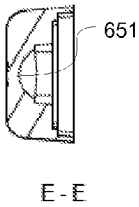
Figure 6H:
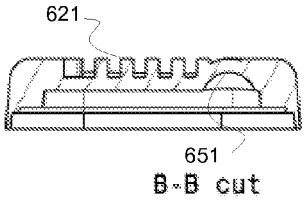

FIG. 6C shows a socket variation that includes a lip 681 around the boundary of the sleeve's yaw range and a fillet 691 parallel to the sleeve's roll axis. FIG. 6D is a bottom view of one embodiment showing treads 621 that may be formed around the outside of the socket for improved surface area in contact with an adhesive, resulting in stronger bonding with the hull. FIG. 6E is a sectional view through section C-C of FIG. 6D showing fillet 691 and a slope angle $\chi$ of the floor of trench 661 away from the fillet. The angle $\chi$ accommodates rolling of the sleeve and in some embodiments defines the limits of the roll angle. FIG. 6F is a sectional view through section D-D of FIG. 6D showing the narrowing of trench 661. FIG. 6G is a sectional view through section E-E of FIG. 6D showing cup 651. FIG. 6H is a sectional view of a section through B-B of FIG. 6D, showing another view of cup 651 and the relief of treads 621.

Figure 7A:
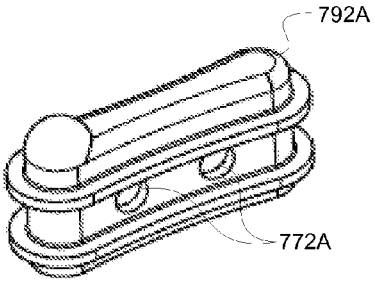
FIGS. 7A-7C illustrate some variations in sleeve design.
Figure 7B:
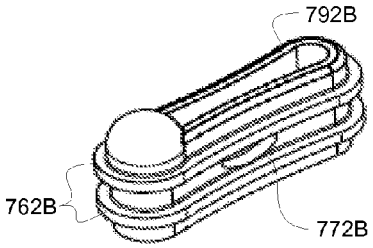
Figure 7C:
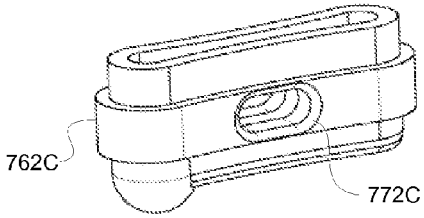

FIGS. 7A-7C illustrate some variations in sleeve design. FIG. 7A shows a sleeve bottom 792A that is solid, resulting in the receptacle (not shown in this figure) being open only at the top, and dual ports 772A for retainers to extend through. FIG. 7B shows a sleeve bottom 792B that is open, so that the receptacle is open at both the top and bottom, and an oval or elliptical port 772B. Any variations of open, closed, or partially closed bottoms may be paired with any suitable port configuration or geometry. FIG. 7C shows a sleeve with a single wide flange 762C to serve the same stiffening and reinforcing function as the pair of flanges 762B. Here, oval-shaped port 772C goes through flange 762C to reach the receptacle.

Figure 8A:
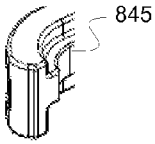
FIGS. 8A-8R illustrate some variations in pad design.
Figure 8B:
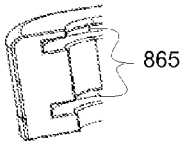
Figure 8C:
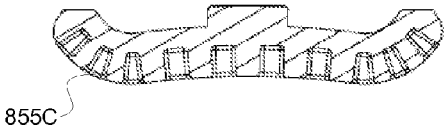
Figure 8D:
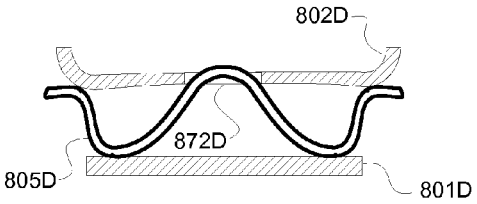
Figure 8E:
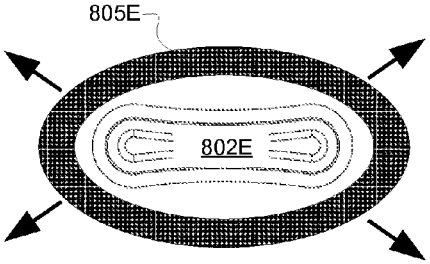
Figure 8F:
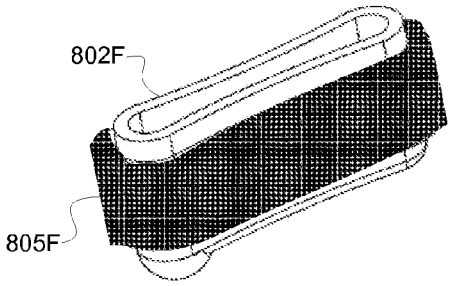
Figure 8G:
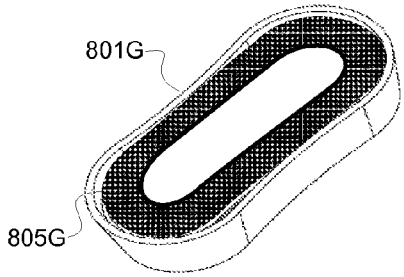
Figure 8H:
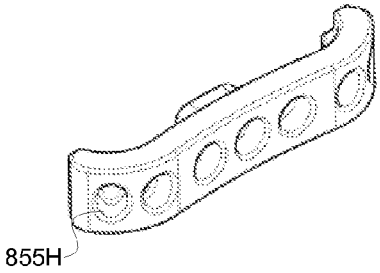
Figure 8I:
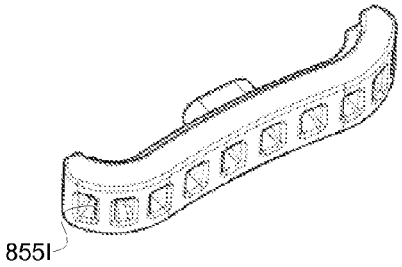
Figure 8J:
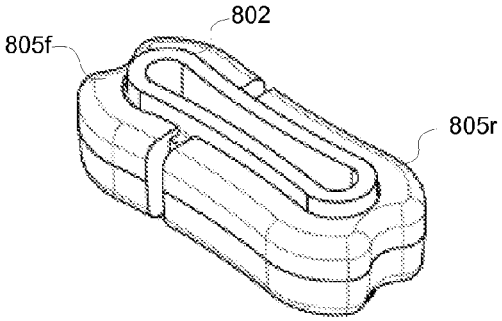
Figure 8K:
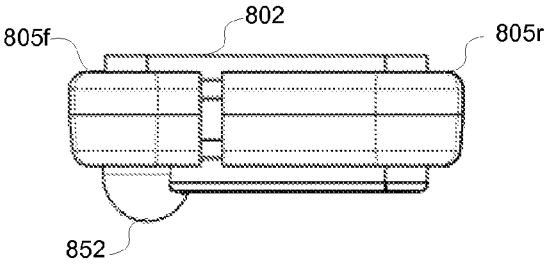
Figure 8L:
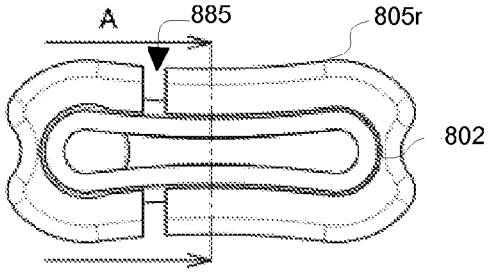
Figure 8M:
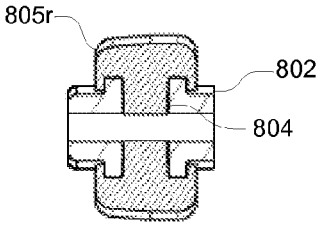
Figure 8N:
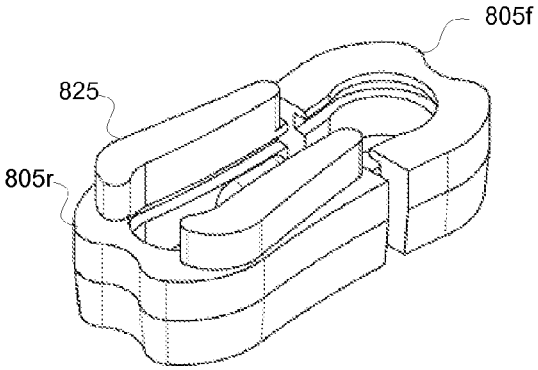
Figure 8O:
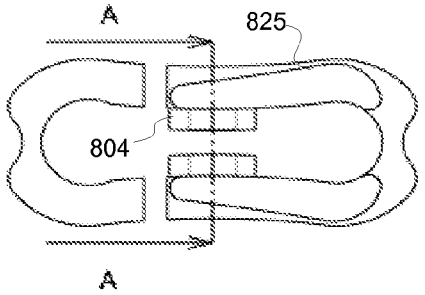
Figure 8P:
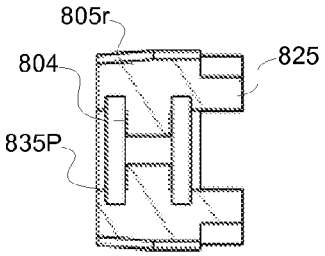
Figure 8Q:
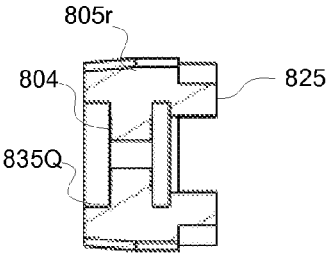
Figure 8R:
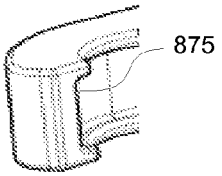

FIGS. 8A-8R illustrate some variations in pad design. For embodiments that use flanges on the outside of the sleeve to position and grip the pad, the mating part of the pad can be a raised inner strip 845 as in FIG. 8A, where the raised inner strip fits between the flanges. Alternatively, the flanges can fit into a pair of grooves 865 in the pad, as in FIG. 8B. Openings 855C in a pad made of deformable material, as shown in FIG. 8C, can be used to manipulate the localized or overall restoring force of the pad. Openings 855C may be through-holes, blind holes, or dimples in the pad surface. FIG. 8D shows the pad embodied as a metal leaf or wave spring 805D, whose curves load the spring between socket 801D and sleeve 802D. Optionally, part of the spring 805D can extend into port 872D in the side of sleeve 802D. FIG. 8E shows a pad embodiment 805E made of stretchable material. Pad 805E can be fabricated as a single piece with an interior through-hole, stretched over sleeve 802E, then allowed to contract to a snug fit around the sleeve. FIG. 8F shows a pad 805F overmolded on sleeve 802F. FIG. 8G shows a pad 805G overmolded into the chamber of a socket 801.

FIG. 8H shows a pad variation with round or elliptical openings 855H. FIG. 8I shows a pad variation with square, rectangular or oblong openings 855I. The openings in some embodiments may be filled with a resilient material different from the main body of the pad or receive a metal spring.

FIGS. 8J-8M show a two-piece pad embodiment assembled from front and rear pieces rather than two side pieces. FIG. 8J is a perspective view, FIG. 8K is a side view, FIG. 8L is a plan view, and FIG. 8M is a section through A-A of FIG. 8L. All the views show front pad piece 805*f* and rear pad piece 805*r* mounted to sleeve 802, with front pad piece 805*f* defined as the piece installed nearer to ball 852; they can be made separately and assembled, or pad pieces may be overmolded on the sleeve in one or more steps. In some embodiments, front pad piece 805*f* and rear pad piece 805*r* can be made of materials with different hardness. In some embodiments, there may be a gap 885 between the front and rear pads when they are assembled on the sleeve, for ease of assembly and to leave room for elastic deformation. In some of those embodiments, the material for front pad piece 805*f* is harder than the material for rear pad piece 805*r*. The harder material in front pad piece 805*f* works mainly to limit roll, while using softer material in rear pad piece 805*r* allows more yaw. Nubs 804 that protrude through sleeve ports to retain the tab are part of rear pad piece 805*r* in the illustrated embodiment. Section A-A in FIG. 8L goes through the nubs 804 which are shown in cross-section in FIG. 8M. The "T"-shaped pad cross-section of FIG. 8M will work with one-piece, two-side-piece, overmolded, and other pad embodiments as well.

FIGS. 8N-8Q show another front/back two-piece pad embodiment. FIG. 8N is a perspective view, FIG. 8O is a plan view, and FIGS. 8P and 8Q are alternative-embodiment sections through A-A of FIG. 8O. These views do not show the sleeve. Here again, front pad piece 805*f* and rear pad piece 805*r* may be made of different materials, and front pad piece 805*f* may be made of a harder material than rear pad piece 805*r*. The illustrated embodiment has a pair of tongues 825 extending from the top surface of rear pad piece 805*r*. Tongues 825 may extend into, or through, slot 443 in lid 403 (see FIG. 4A), forming a seal around tab 412 between lid 403, sleeve 402, and cushion 406 or the base of foil 411, excluding water from the mounting. Section A-A in FIG. 8O goes through the nubs 804 which are shown in cross-section in FIGS. 8P and 8Q. The bottom of rear pad piece 805*r* may have features 835P that wrap around the bottom of the lower flange of the sleeve, or may accommodate that flange in a more open slot 835Q.

FIG. 8R shows a pad adapted for a single-flange sleeve embodiment. Single wide groove 875 accommodates a single wide flange such as 762C in FIG. 7C.

FIGS. 9A-9H illustrate a variant embodiment of the previously defined foil mounting configured for use within a translation cage. In applications such as sailboarding, longboarding, paddle boarding, and piloting of other small watercraft, a user may wish to adjust the position of a foil between rides and fix it in an optimal longitudinal position for a present set of conditions. In these embodiments, instead of mounting the socket directly into the hull, a translation cage is mounted in the hull and the socket is adjustably mounted in the cage.

Figure 9A:
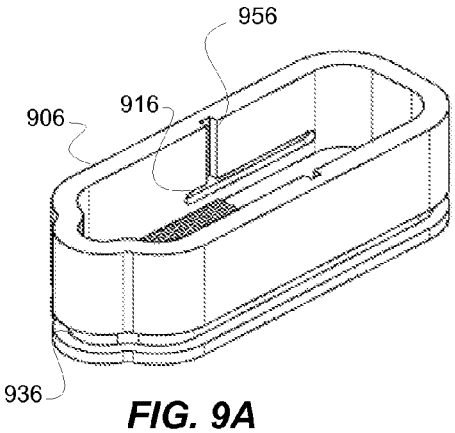
FIGS. 9A-9J illustrate embodiments of a socket variation configured for use with a translation cage.
Figure 9B:
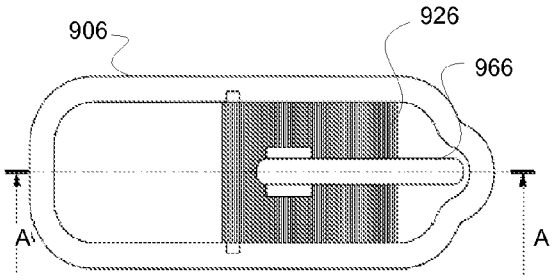
Figure 9C:
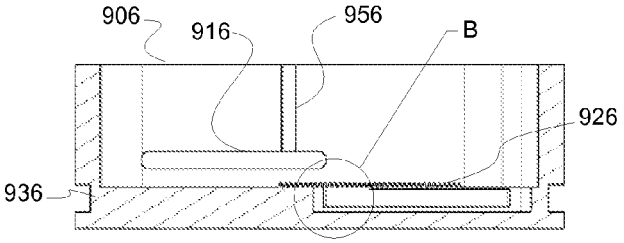

FIGS. 9A-9C are a perspective view, a plan view, and a sectional view through A-A of FIG. 9B of an embodiment of a translation cage 906. Suggested materials are similar to those of the socket: metals, harder polymers, carbon-fiber materials, ceramics, and the like. In some embodiments, the cage and socket are made of the same material or of materials with substantially matched coefficients of thermal expansion. Translation cage 906 includes a horizontal guide 916 and vertical guide 956 on an inner wall surface, a series of cage teeth 926 on a floor surface, a bottom slot 966 and optionally an outer groove 936 to aid in secure mounting.

Figure 9D:
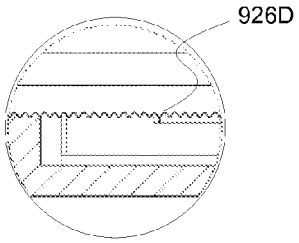
Figure 9E:
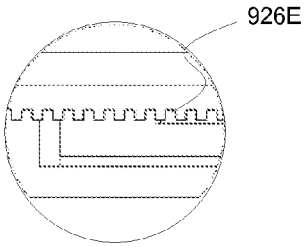
Figure 9F:
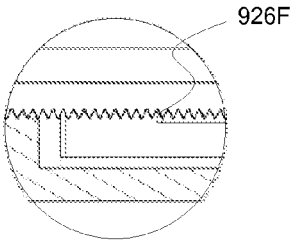

FIGS. 9D-9F are magnifications of area B in FIG. 9C of a few alternative embodiments of cage teeth 926D, 926E, and 926F. These examples are not limiting; any periodic shape (repeating cylinders, triangles, square, trapezoidal, sinusoidal, sawtooth, or any suitable tooth profile used in the art for gears, racks and pinions, and the like) may be used.

Figure 9G:
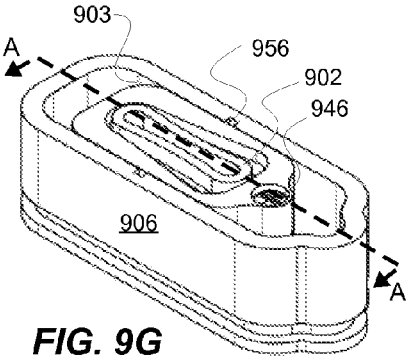
Figure 9H:
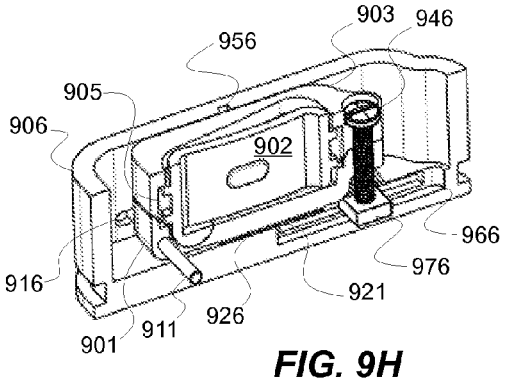

FIGS. 9G and 9H are views of a partially-assembled embodiment of a translation-enabled foil mounting. FIG. 9G is an assembled perspective view showing lid 903 and sleeve 902 assembled in cage 906 and anchored with fastener 946. Some embodiments include a cage lid to exclude water from the interior of the translation cage. It is a larger version of the socket lid and includes a slot to allow insertion, yaw, and roll of a foil tab. The cage lid is omitted from these views to better exhibit the assembly of the other parts.

FIG. 9H is a cutaway through sectioning line A-A of FIG. 9G. Lid 903, sleeve 902, cage 906, fastener 946, socket 901 and pad 905 are visible in this view, as is a nut 976 that engages with fastener 946 and bottom slot 966. The embodiment of socket 901 configured for mounting in translation cage 906 has a transverse pin 911 that slides in the horizontal guides 916 of cage 906. The socket also includes socket teeth 921 on its bottom surface, configured to mesh with cage teeth 926. To install the socket/sleeve/pad/lid assembly in translation cage 906, transverse pin 911 is inserted in vertical guides 956 and slides down and into horizontal guide 916. Fastener 946 is engaged (e.g., threaded into) nut 976 but not fully tightened.

Figure 9I:
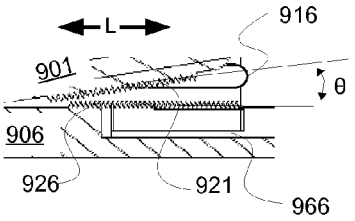
Figure 9J:
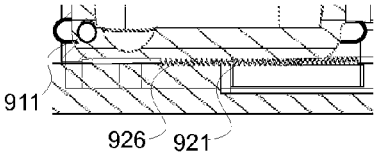

FIGS. 9I and 9J are close-ups of the FIG. 9H sectional view showing a translation adjustment of the socket/lid/pad/sleeve mounting subassembly ("socket subassembly") in the translation cage. Fastener 946 is loosened (or, in some embodiments, may be removed). The socket subassembly is tilted by an angle θ to unmesh socket teeth 921 from cage teeth 926 (FIG. 9I). When the sets of teeth are unmeshed, the socket subassembly is free to slide in longitudinal direction L, optionally constrained by pin 911 sliding in horizontal guide 916. After adjusting socket 901 to a desired position within translation cage 906, the user un-tilts socket 901, allowing socket teeth 921 to mesh with cage teeth 926 in the new position (FIG. 9J). The socket subassembly is then locked in its new position by tightening fastener 946 in nut 976. Thus, the tightening of fastener 946 need not hold the socket subassembly in place by itself, but is assisted in anchoring the position by the two meshed sets of teeth. Alternatively, the locking may be done by a snap or detent. In some embodiments, the cage lid itself locks the socket in position within the translation cage; in other embodiments, a snap, detent, or fastener may be used in a different location within the cage. After locking the socket in the desired position and replacing the cage lid, the user re-inserts the foil for operation.

Figure 10A:
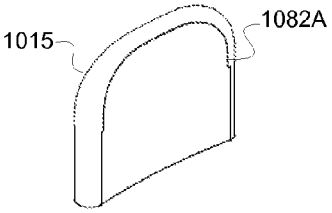
FIGS. 10A-10G illustrate some variations in tab design.
Figure 10B:
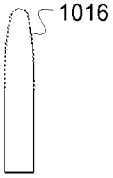
Figure 10C:
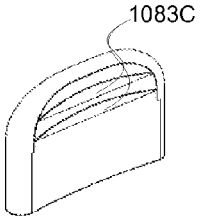
Figure 10D:
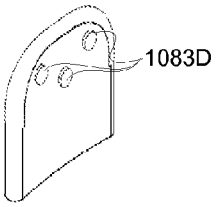
Figure 10E:
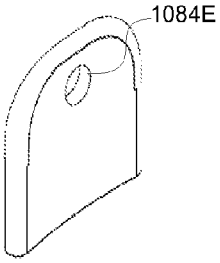
Figure 10F:
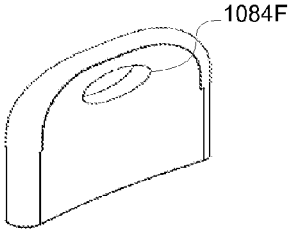
Figure 10G:
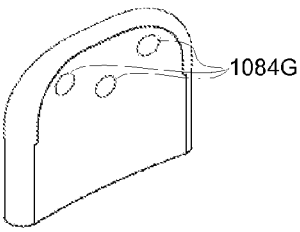

FIGS. 10A-10G illustrate some variations in tab design. FIGS. 10A and 10B are side and end views of a tab with tapers 1015 and 1016 to accommodate draft in the foil cavity where the tab is inserted. Various embodiments have different gripping structures to increase the effective surface area adhering inside the foil cavity. Ridge 1082A in FIG. 10A creates an overhang around the inserted end of the tab. One or more ridges 1083C as shown in FIG. 10C act like barbs to keep the tab from pulling out of the hardened adhesive or overmold, but the ridges may alternatively be oriented at other angles. One or more protrusions 1083D, a round hole 1084E, an oval hole 1084F, or multiple holes 1084G (or holes and protrusions of other suitable shapes) may also act as gripping features for adhesive or curable polymer to flow into, or interfaces with other structural elements inside the foil.

Figure 11A:
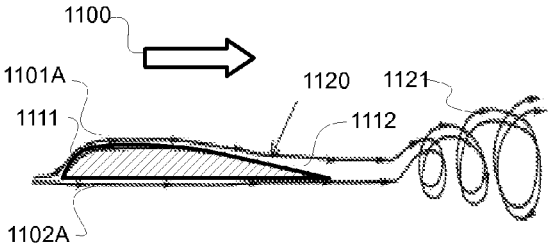
FIGS. 11A-11J illustrate some variations in cushion and foil design.
Figure 11B:
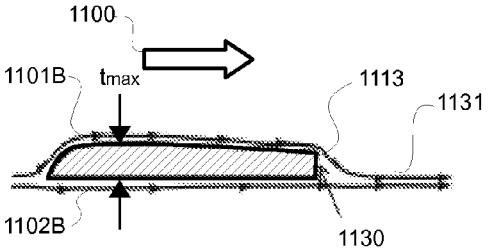

FIGS. 11A-11J illustrate variations in cushion and foil base profile design. FIGS. 11A and 11B compare fluid flow past different foil cross-sections. To show the effects clearly, the foil aspect ratio is distorted; many foil embodiments are longer and thinner than suggested by these illustrations. The foil section at its base in FIG. 11A has a leading taper 1111 and a trailing taper 1112. When positioned in ambient fluid (either liquid or gas) flowing in direction 1100, the foil splits the flow into stream 1101A over tapers 1111 and 1112 and stream 1102A along the planar side. Flow is laminar (smooth) over most of the body of the foil, but then laminar stream 1101A "unhooks" from the foil surface when it reaches unhooking zone 1120 or turbulent rake, resulting in turbulence 1121 and swirl formation abaft of trailing taper 1112. The turbulence and swirls cause drag, hampering acceleration and maneuverability and sometimes reducing speed or causing loss of control.

By contrast, the foil cross-section in FIG. 11B has a thickened trailing end 1113 out of its base and little or no trailing taper (e.g. 2-7 degrees). This thickened trailing end is equal to or slightly less than the maximum thickness of profile $t_{max}$, and the shape is squared-off or otherwise sharp-edged rather than having a trailing taper similar to 1112. The sharp edge or square cut creates a low pressure at trailing edge to prevent fluid unhooking so that the flow remains substantially laminar rather than turbulent and prevent cavitation. The reduction in turbulence improves acceleration and maneuverability and reduces the risk of losing control.

Figure 11C:
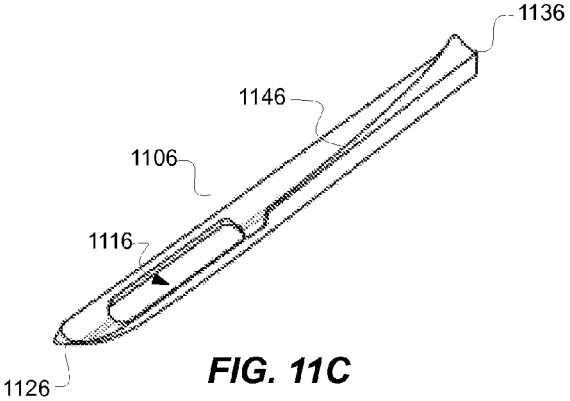

FIG. 11C is a perspective view of a foil cushion conferring the laminar flow advantages of the thickened-trailing-end cross-section of FIG. 11B on the base of the foil where it meets the hull. Cushion 1106 has a thickened trailing end 1136 at the end of a complementary taper 1146. Complementary taper 1146 can follow the contour of a foil with a trailing taper 1112 or a tapered cutout in the base of a foil that has a thickened trailing end 1113. Through-hole 1116 admits the tab. Concave trough 1126 seals and cushions around a foil with a filleted base. Particularly when a mounting allows larger roll angles, a fillet or chamfer on the base of the foil allows the foil to roll without a sharp corner digging into the hull and possibly levering the tab out of place.

Figure 11D:
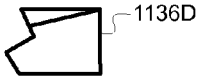
Figure 11E:
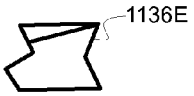
Figure 11F:
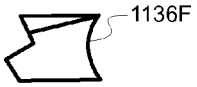
Figure 11G:
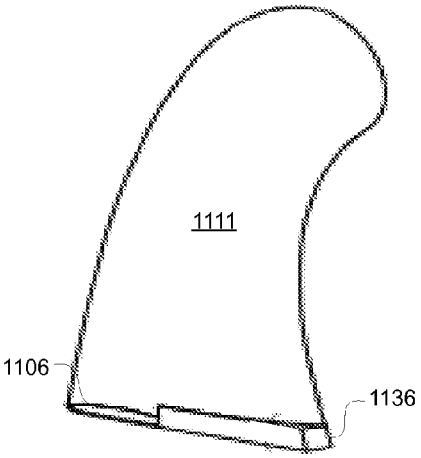

FIGS. 11D, 11E and 11F are plan views of alternative profiles of thickened trailing ends of a cushion; squared-off as in 1136D, V-shaped as in 1136E, or concave as in 1136F. FIG. 11G is a perspective view of a foil 1111 assembled with a cushion 1106 showing the thickened trailing end 1136 of the cushion 1106.

Figure 11H:
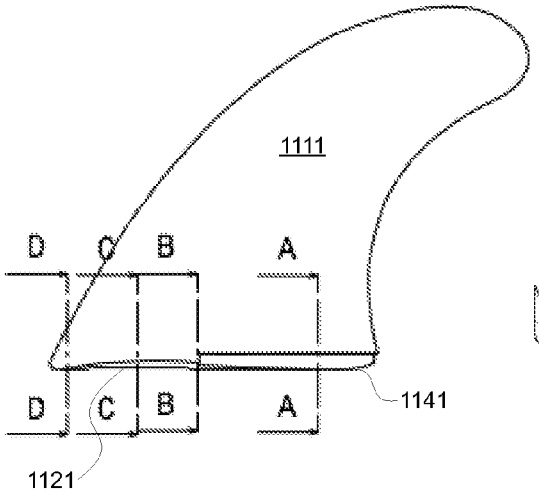
Figure 11I:
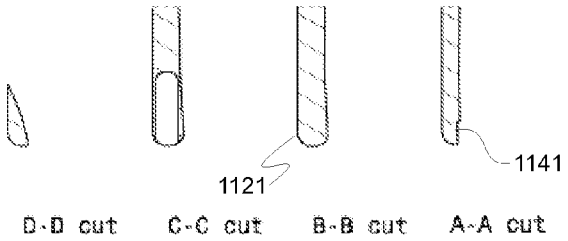

FIG. 11H is a side view of an embodiment of a foil with sectioning lines. FIG. 111 is a group of sectional views corresponding to the section lines in FIG. 11H. These views show the fillets 1121 for extending the roll range without stressing the hull or putting excess leverage on the tab, as well as tapered cutout 1141 for the cushion with a thickened trailing end.

Figure 11J:
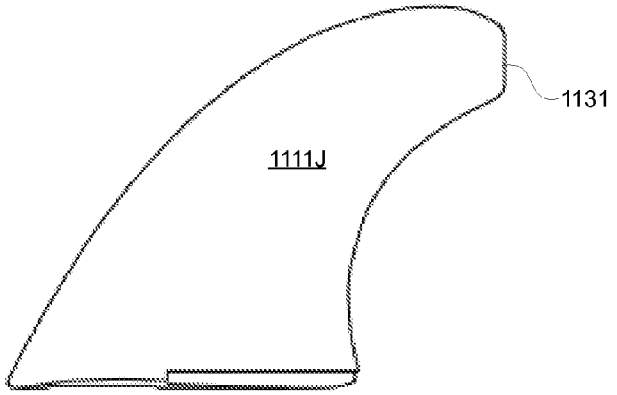

FIG. 11J is a side view of a foil embodiment with a squared-off trailing tip end 1131. Analogous to the thickened trailing cushion end 1136, except positioned farther from the hull, this type of tip operates on the same fluid-dynamic principle illustrated in FIG. 11B, and the thickened trailing tip end can have any of the end profiles illustrated in FIGS. 11D-11F.

FIGS. 12A-12F illustrate an embodiment of a manufacturing method that includes wicking a curable adhesive, resin, or other hardening material into peripheral channels around a socket or cage cavity to form reinforcing vanes. Some hulls include a thin, hard outer layer (such as fiberglass) over a weaker, softer, sometimes porous or crumble-prone core (such as foam). Hydrodynamic stresses on a mounted foil, as well as the stress of multiple mountings and dismountings of a removable foil, can eventually weaken the bond between the core material and the mounting socket or cage until the mounting socket or cage may be accidentally pulled out of the hull. These reinforcing vanes increase the effective surface area of hull core material engaged in the bond, and also act similarly to the barbs on a fish-hook to keep the socket or cage firmly embedded in the hull.

Figure 12A:
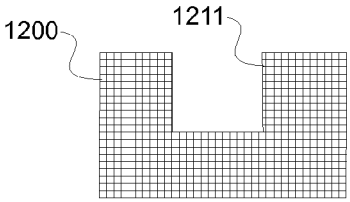
FIGS. 12A-12G illustrate an embodiment of a manufacturing method that includes wicking a hardening adhesive into peripheral channels around a socket cavity to form reinforcing vanes.
Figure 12B:
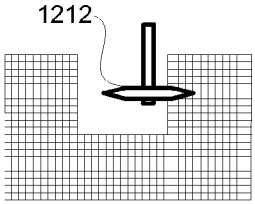
Figure 12C:
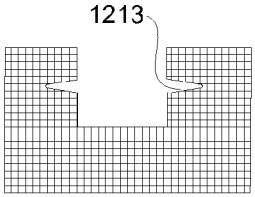
Figure 12D:
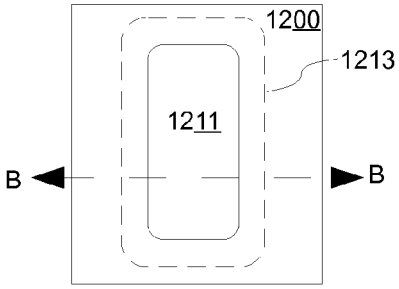

FIGS. 12A-12C are conceptual sectional views through section B-B of the plan view in FIG. 12D. Initially, a cavity 1211 is formed in a hull 1200. Cavity 1211 has suitable dimensions to accommodate a socket or cage for a foil mounting with enough clearance for wicking of the liquid phase of the hardening material. Next, a cutting tool such as shaft-mounted rotary cutter 1212 cuts at least one transverse channel 1213 that extends into hull 1200 from the periphery of cavity 1211. Transverse channel 1213 may encompass the entire periphery of cavity 1211 as shown in the plan view FIG. 12D, or may only extend from one or more selected sections of the periphery. Multiple peripheral channels may be cut at different levels within cavity 1211.

Figure 12E:
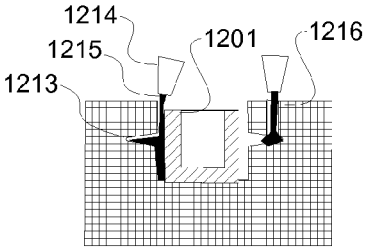
Figure 12F:
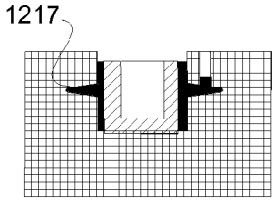
Figure 12G:
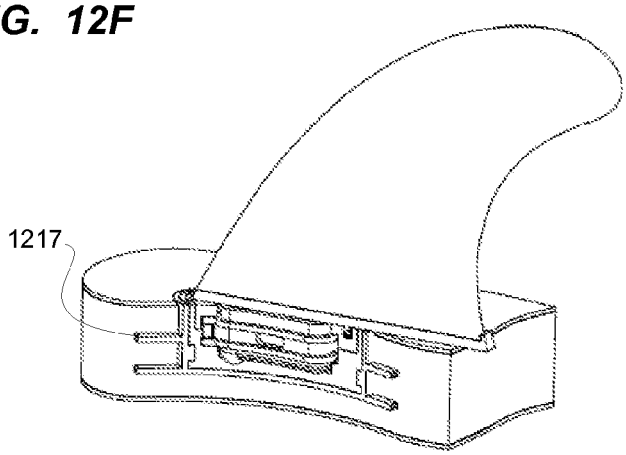

Socket or cage 1201 is inserted in cavity 1211 as in FIG. 12E, and a liquid-phase hardenable material 1215 is injected, for example from a nozzle 1214. Material 1215 fills part or all of the clearance space between socket or cage 1201 and the walls of cavity 1211, and wicks to fill part or all of peripheral transverse channel 1213. In some embodiments, an additional injection hole 1216 may be drilled or otherwise formed in hull 1200 to fill channel 1213 more directly. This may be convenient, for example, if material 1215 is particularly viscous or if channel 1213 extends particularly far from the periphery of cavity 1211. When material 1215 hardens, it forms a solid reinforcing vane 1217. The connection of reinforcing vane 1217 to socket or cage 1201 (by the additional material injected between the socket or cage and the cavity wall) causes the reinforcing vane to become integrated with the socket or cage and act to anchor it firmly in place in the hull.

Figure 13A:
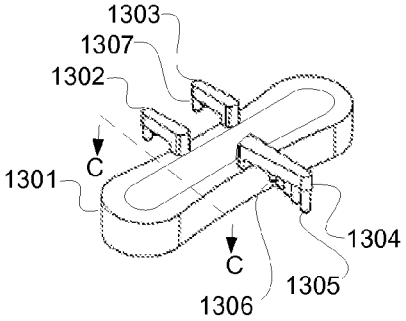
FIGS. 13A-13C illustrate an embodiment of a manufacturing method using frangible pegs to set the default orientation of a socket relative to a hull.
Figure 13B:
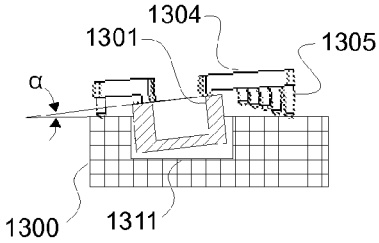
Figure 13C:
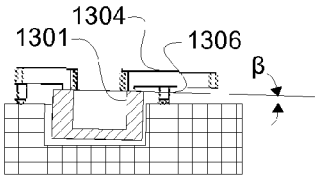

FIGS. 13A-13C illustrate an embodiment of a manufacturing method using frangible pegs to set the default orientation of a socket (or cage) relative to a hull. Socket 1301 has three legs 1302, 1303, 1304 extending from its upper rim. Each leg has at least one positioning peg 1307. At least one of the legs (in the illustration, 1304) has at least two frangible positioning pegs of different lengths, 1305 and 1306. FIGS. 13B and 13C are sectional views through section C-C of the perspective view of FIG. 13A. Cavity 1311 in hull 1300 is deep enough so that a positioning peg on each of the three legs 1302, 1303, 1304 touches the hull surface around the cavity, defining the plane of contact with the hull. The legs support socket 1301 at those three points rather than allowing the bottom of socket 1301 to reach the bottom of cavity 1311. In FIG. 13B, the longest peg 1305 on leg 1304 has been left on so that the socket angle (which becomes the roll-neutral angle of the foil) is $\alpha$. In FIG. 13C, all but the shortest peg 1306 has been broken off of leg 1304 so that the socket angle is $\beta$. In some embodiments, legs 1302-1304 are broken off after the socket is affixed to the hull at the desired angle. In others, the pegged socket is installed on an inner layer of the hull and one or more additional layers (e.g. foam, fiberglass) is applied over the legs, so the legs become reinforcing members. With this method, foil mountings can be easily installed at a range of angles without needing to make, ship, and store a different part for each angle, or using an angular jig to hold the socket stably at the desired angle while affixing it to the hull.

The above description and the accompanying drawings are intended as non-limiting examples of various embodiments. The limits of patent protection are defined only by the appended claims and their equivalents.

I claim:

1. An interchangeable foil system, comprising:

a removable foil comprising a tab protruding from a base, and a foil mounting assembly, comprising:

a sleeve having a ball on an outer surface and a receptacle configured to receive the tab, a retainer extending within the receptacle and engage-able with the tab, a socket containing the sleeve and the retainer in a chamber and seating the ball rotatably in a cup, a resilient pad between the sleeve and an inner wall of the chamber, and a lid confining the sleeve, the retainer, and the pad within the socket and having a slot through which the tab may enter the receptacle, where the tab is inserted through the slot into the receptacle in an insertion direction, where the retainer retains the tab in the receptacle until the tab is pulled in a direction opposite the insertion direction with at least a minimum removal force, where a lateral pressure on the foil when the tab is in the receptacle causes the sleeve to yaw and roll in the chamber as the ball rotates in the cup, and where the pad exerts a restoring force to return the sleeve to a neutral orientation as the lateral pressure subsides.

2. The system of claim 1, where the ball is located near an outer corner of the socket.

3. The system of claim 1, where the chamber, sleeve, foil base, and lid are configured to prevent the foil from pitching in response to fluid-dynamic pressure.

4. The system of claim 1, where ranges of the yaw and roll of the sleeve are determined by one of:

a lateral clearance between an outer surface of the sleeve and an inner wall of the chamber, a lateral clearance between the tab seated in the sleeve and the slot in the lid, a compressibility or width of the base, and a clearance between the base and the hull.

5. The system of claim 1, where the tab comprises two posts and a torsion web between the two posts.

6. The system of claim 1, where the retainer holds the tab by compression, friction, or a combination of compression and friction.

7. The system of claim 1, where the retainer is integrated with the pad.

8. The system of claim 7, where the retainer extends into the receptacle through a port in the sleeve.

9. The system of claim 1, where the pad comprises one of an elastomer and a leaf spring.

10. The system of claim 1, where the pad is pre-loaded more strongly on one side of the sleeve than on an opposing side of the sleeve.

11. The system of claim 1, where the pad acts as a damping spring, resisting the sleeve more and more as it nears the limits of its allowed yaw and roll range.

12. The system of claim 1, where the pad includes a tongue that extends into the slot, and where the tongue is configured to prevent ambient water from entering the slot, the receptacle, or the chamber.

13. The system of claim 1, where the sleeve comprises one of a stiffening flange around a perimeter of the receptacle and a convex barrel extending from a vicinity of the ball.

14. The system of claim 1, where the socket is mounted in the hull.

15. The system of claim 1, further comprising a translation cage fixedly mounted in the hull, where the socket is mounted in the translation cage in an adjustable position and the lid confines the socket in the translation cage.

16. The system of claim 15, further comprising:

socket teeth on an outer socket surface, cage teeth on an inner cage surface, and a removable fastener configured to anchor the socket to the cage with the socket teeth and the cage teeth meshed in any of a plurality of positions when the fastener is fully engaged.

17. The system of claim 16, further comprising a guide configured to guide the socket from one of the positions to another when the fastener is not fully engaged.

18. The system of claim 1, further comprising a thickened trailing end on the base or a tip of the foil configured to reduce turbulence aft of the foil.

19. The system of claim 1, further comprising an elastically deformable cushion covering the base of the foil, where the tab protrudes through the cushion.

20. The system of claim 19, where the cushion comprises a thickened trailing end configured to reduce turbulence aft of the foil.

21. The system of claim 20, where the thickened trailing end has a substantially squared-off shape, where the squared-off shape creates a low-pressure zone aft of the foil, and where the low-pressure zone increases laminar flow of fluid around the foil.

22. The system of claim 19, where a shape of the elastically deformable cushion adapts to changing flow speed and fluid pressure.

23. A method of improving the fluid-dynamic performance of a hull, the method comprising:

coupling a foil to the hull with a mount comprising a ball-and-cup joint that allows the foil to yaw and roll through a limited range in response to lateral pressure from the ambient fluid, and providing a restoring force in the mount that automatically returns the foil to a neutral orientation as the lateral pressure subsides.

24. The method of claim 23, further comprising:

incorporating the cup of a ball-and-cup joint in a socket, mounting the socket adjustably in a translation cage, and adjusting the position of the socket by at least partially disengaging a fastener, unmeshing socket teeth from cage teeth, moving the socket to a new position in the translation cage, meshing the socket teeth with the cage teeth in the new position, and fully re-engaging the fastener to anchor the socket in the new position.

25. The method of claim 24, where moving the socket comprises sliding the socket along a guide built into the translation cage.

26. A method of attaching a foil-mounting component to a hull, comprising:

forming a cavity in the hull, where the cavity accommodates a portion of the component to be recessed in the hull with clearance for a liquid phase of a hardening material to flow around the component, cutting a transverse channel extending laterally into the hull from a periphery of the cavity, selecting a mounting angle by breaking, or electing not to break, a frangible peg on the component, where the frangible peg provides a point of contact between the component and the hull, inserting the component into the cavity, injecting the liquid phase of the hardening material into at least part of the cavity and at least part of the transverse channel, and hardening the hardening material to form a rigid structure bonding the component into the cavity and comprising a reinforcing vane formed by the portion of the hardening material in the transverse channel.

* * * * *